US012000592B1

(12) United States Patent
Ressler et al.

(10) Patent No.: US 12,000,592 B1
(45) Date of Patent: Jun. 4, 2024

(54) FIRE PIT VENTILATION INSERT RING

(71) Applicant: Lamplight Farms Incorporated, Menomonee Falls, WI (US)

(72) Inventors: Kyle Ressler, West Bend, WI (US); Andrew Alan Harmeling, Milwaukee, WI (US); Daniel J. Knight, Murfreesboro, TN (US)

(73) Assignee: Lamplight Farms Incorporated, Menomonee Falls, WI (US)

( * ) Notice: Subject to any disclaimer, the term of this patent is extended or adjusted under 35 U.S.C. 154(b) by 313 days.

(21) Appl. No.: 17/339,670

(22) Filed: Jun. 4, 2021

(51) Int. Cl.
*F24B 3/00* (2006.01)
*F24B 5/02* (2006.01)
*F24B 13/00* (2006.01)

(52) U.S. Cl.
CPC ..... *F24B 3/00* (2013.01); *F24B 5/023* (2013.01); *F24B 13/002* (2013.01)

(58) Field of Classification Search
CPC ..... F24B 5/021
See application file for complete search history.

(56) References Cited

U.S. PATENT DOCUMENTS

| | | | | |
|---|---|---|---|---|
| D858,729 | S * | 9/2019 | Scott | D23/348 |
| 11,391,465 | B1 * | 7/2022 | Weilert | F24C 15/08 |
| 11,585,534 | B2 * | 2/2023 | Stoltzfus | F24B 3/00 |
| 2012/0196232 | A1 * | 8/2012 | Miller | F24B 3/00 431/2 |
| 2013/0081609 | A1 * | 4/2013 | Dhuper | A47J 37/0781 126/25 AA |
| 2013/0263841 | A1 * | 10/2013 | Terpstra | B65B 11/00 414/800 |
| 2016/0166109 | A1 * | 6/2016 | Banal | A47B 11/00 108/50.13 |
| 2019/0137107 | A1 * | 5/2019 | Crosen | F24B 1/181 |
| 2020/0096199 | A1 * | 3/2020 | Harrington | F24B 5/025 |
| 2020/0208842 | A1 * | 7/2020 | Jan | F24B 1/195 |
| 2021/0321821 | A1 * | 10/2021 | Stoltzfus | F24B 1/182 |
| 2022/0243920 | A1 * | 8/2022 | Jan | F24B 1/192 |
| 2022/0349582 | A1 * | 11/2022 | Stoltzfus | F24B 13/02 |

* cited by examiner

*Primary Examiner* — David J Laux
(74) *Attorney, Agent, or Firm* — GableGotwals; David G. Woodral

(57) ABSTRACT

An insert ring that suspends a fire pit at least partially within an opening of a support structure, and provides ventilation into the support structure to an outer wall of the fire pit.

14 Claims, 5 Drawing Sheets

FIRE PIT VENTILATION INSERT RING

FIELD OF THE INVENTION

This disclosure relates to outdoor combustion devices in general and, more specifically, to outdoor solid fuel fire pits.

BACKGROUND OF THE INVENTION

Various outdoor fire pits utilize particular arrangements of air inlets and air flow configurations to improve light output or flame appearance while reducing smoke and undesirable wind effects. In some cases, outdoor fire pits may be configured to take air in through the exterior of the fire pit and then deliver it in a particular way to an interior where combustion of solid fuel occurs. This means that users may be unable to install a fire pit into a permanent structure, or even certain decorative structures, without either being limited in the design of such structure (e.g., being required to provide for additional external ventilation ports) or diminishing the performance of the fire pit.

What is needed is a system and method for address the above and related considerations.

SUMMARY OF THE INVENTION

The invention of the present disclosure, in one aspect thereof, comprises a fire pit insert ring for use with a fire pit installation. The fire pit ring includes a surround defining an opening sized to accept a fire pit, and a vent panel attached to the surround and defining a plurality of vent openings. The vent panel provide airflow into the installation and to an outer wall of the firepit.

The opening defined by the surround may be sized to pass at least a portion of the outer wall of the firepit therethrough and to suspend the firepit in the installation by a rim of an upper cover of the fire pit. The vent panel may descend below the surround. A circumference of the vent panel may be sized to rest on an upper ledge of the installation and provide air flow below the surround and inwardly toward the outer wall of the firepit. The surround may slope downwardly away from the upper cover of the fire pit. In some cases, the vent panel slopes downwardly from the surround at an angle exceeding a downward sloping angle of the surround. The downward sloping angle of the surround may be approximately equal to a downward sloping angle of the upper cover of the fire pit.

The invention of the present disclosure, in another aspect thereof, comprises a fire pit insert ring for use with a fire pit installation. The insert ring includes surround having a panel spanning a distance between a firepit and an upper ledge of the installation suspending the fire pit partially inside the installation. The panel has at least one support ledge in contact with the fire pit and at least one rebated portion spaced apart from the firepit such that air flow is provided between the rebated portion and the firepit allowing air flow into the installation.

The panel may be divided into segments, each segment having a support ledge on both opposite ends thereof and a rebated portion on a medial portion thereof. The segments may join together to define a circular opening accepting the fire pit. In some embodiments, the support ledges of each segment face inwardly and support the fire pit in a suspended fashion via a rim on an upper cover of the fire pit. The panels have a downward slope away from the fire pit that approximately equates to a downward slope of the upper cover of the fire pit.

The invention of the present disclosure, in another aspect thereof, comprises a fire pit installation including a support structure having a support wall defining an opening on a top thereof and an upper ledge surrounding the opening and a fire pit having an outer wall with an air intake defined therein, an inner wall defining a combustion chamber, and an upper cover spanning between the outer wall and the inner wall, the upper cover providing a rim protruding outwardly from the outer wall. The installation includes an insert ring that suspends the fire pit by the rim at least partially within the opening of the support structure, the insert ring providing ventilation into the support structure to the outer wall of the fire pit.

In some embodiments the insert ring has a surround defining an opening receiving the fire pit and a vent panel descending from the surround to contact the upper ledge of the support structure. The surround may define a circular opening. In some cases, the vent panel descends approximately vertically from the surround. The surround may slope outwardly down from the fire pit.

In other embodiments, the insert ring defines a circular opening and provides a plurality of inwardly projecting support ledges that engage the rim of the fire pit. The insert ring may define a plurality of rebated portions spaced apart from the fire pit providing the ventilation into the support structure. The insert ring may be divided into a plurality of separable segments each having at least one of the plurality of support ledges and at least one of the plurality of rebated portions.

DETAILED DESCRIPTION OF THE PREFERRED EMBODIMENTS

Figure 1:
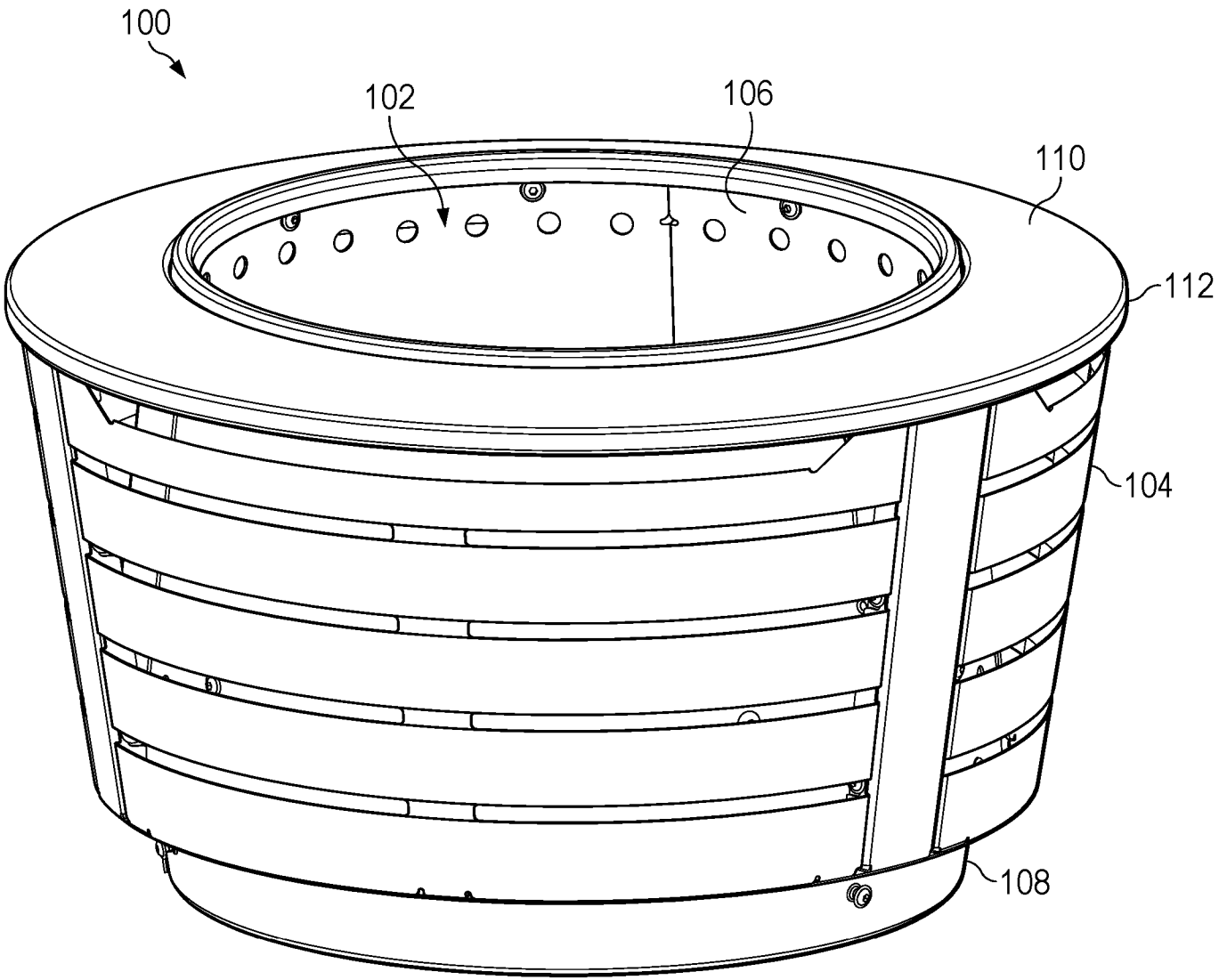
FIG. 1 is a perspective view of a fire pit.

Referring now to FIG. 1, a perspective view of a fire pit 100 is shown. The fire pit 100 may comprise a solid fuel engine or combustion chamber 102 that burns solid fuel such as natural logs, synthetic or manufactured logs, wood pellets, bagged or prepackaged fuel, or other fuels. Ventilation or air supply may be provided at various locations in the combustion chamber 102 to maximize flame, minimize smoke, and/or accomplish a variety of other goals. In some cases, air enters the fire pit 100 via openings in outer all 104. The wall 104 may be slatted or otherwise perforated for admitting air. An inner wall 106 may at least partially define the combustion chamber 102 and define various air intakes to the combustion chamber 102. A fire pit that operates similarly to the manner described is disclosed in US Patent Application Publication No. US 2020/0096199 A1 by Harrington, et al., which is hereby incorporated by reference.

As shown, the firepit 100 has a top cover 110 spanning what would otherwise be an open space between walls 104, 106. An outer rim 112 is provided that may overhang the wall 104 by a sufficient amount that the fire pit 100 may be lifted or elevated thereby as discussed further below. The fire pit 100 may sit on a base 108 or may be provided with a stand for elevating the fire pit 100 to a more desirable height and/or reduce the chance of scorching grass or other material near the fire pit 100. Various ash handling mechanisms may also be provided.

It should be appreciated that in some embodiments the exact configuration of a fire pit suitable for use with embodiments of the fire pit ventilation ring may vary. While there may be particular advantageous to a system employing a fire pit as described herein, any fire pit benefiting from or requiring external air flow may realize increased utility in terms of installation options utilizing fire pit ventilation rings and other aspects of the present disclosure. Additionally, while embodiments of the present disclosure are described as relying on the outer rim 112 for suspending the firepit, other implements of a particular fire pit may be utilized in this regard. For example, specific mounting brackets, handles, or other protrusion may serve to good effect for allowing a fire pit to be affixed to or suspended by various ventilation rings according to the present disclosure.

Figure 2:
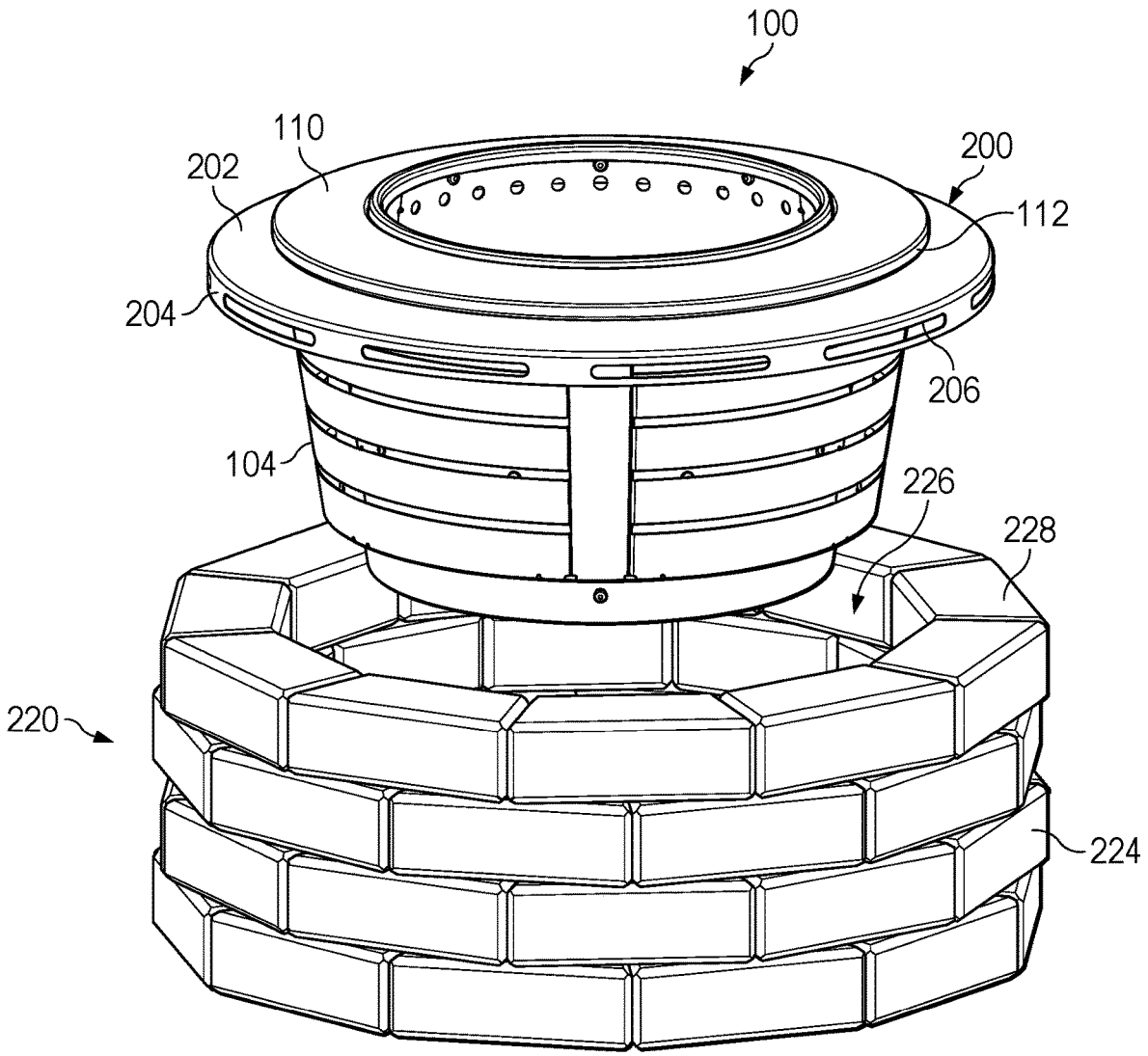
FIG. 2 is an exploded perspective view of a fire pit utilizing a fire pit ventilation insert ring according to aspects the present disclosure for mounting within a masonry installation.
Figure 3:
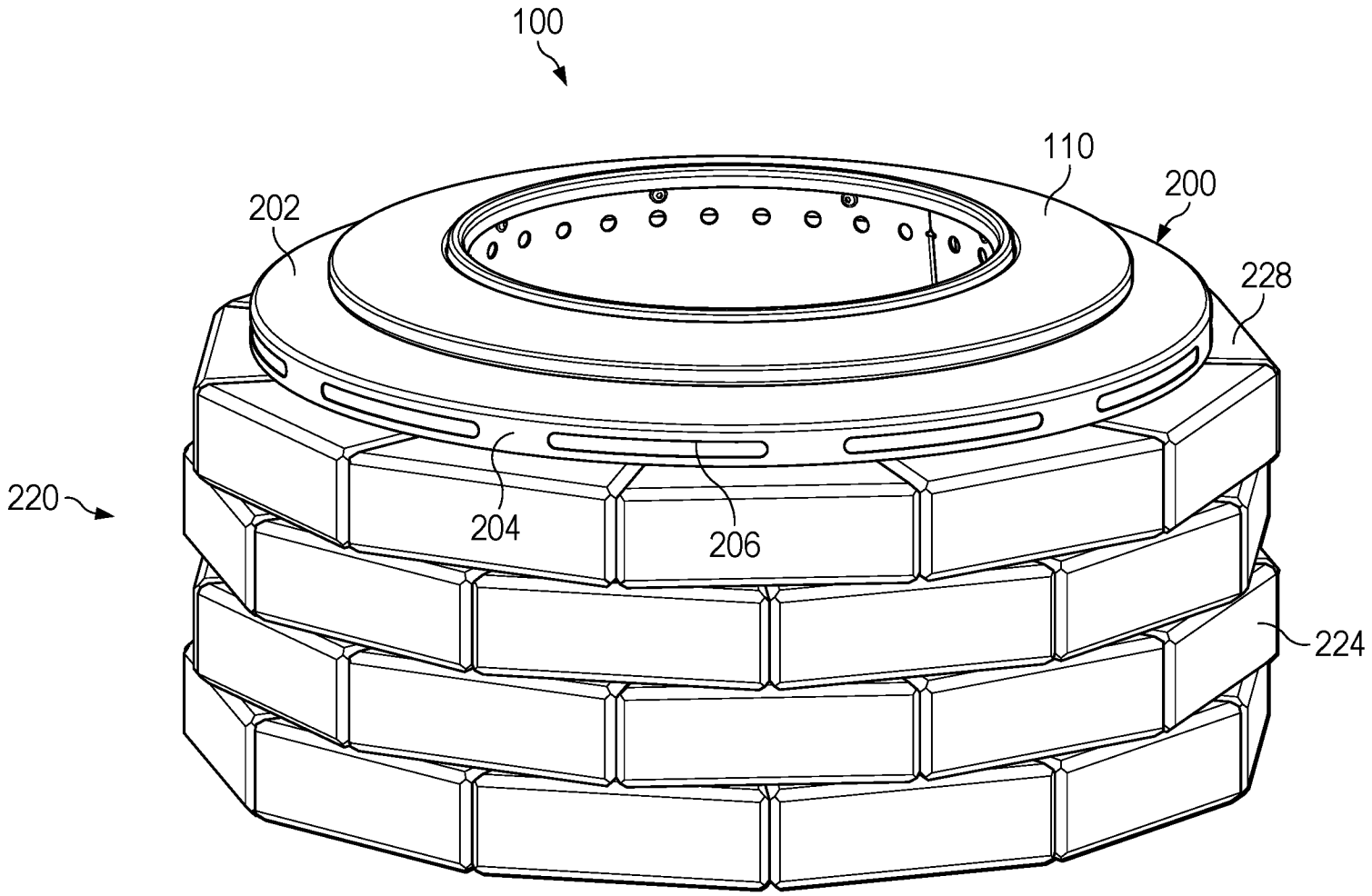
FIG. 3 is a perspective view of the fire pit of FIG. 3 with masonry installation enabled by the fire pit ventilation insert ring of the present disclosure.

Referring now to FIG. 2, an exploded perspective view of a fire pit 100 utilizing a fire pit ventilation insert ring 200 according to aspects the present disclosure, for mounting within a masonry installation 220, is shown. FIG. 3 is a perspective view of the fire pit 100 of FIG. 3 with masonry installation 220 enabled by a fire pit ventilation insert ring 200 of the present disclosure. The ventilation ring 200 may comprise a surround 202 defining an opening that receives the firepit 100 and suspends it via the rim 112. The opening (occupied by fire pit 100) defined by the surround 200 may be circular or have another shape compatible with the fire pit 100, rim 112, and associated structures. The central opening of the surround 202 may be sized to fit the outer wall 104 near where the wall 104 fits into the rim 112.

The surround 202 may be flat or horizontal or it may slope away from the central opening of the fire pit 100. In some embodiments, an outward downward slope or angle of the surround 202 matches or approximately matches an outward downward slope or angle of the top cover 110.

Descending at an angle downward from the surround 202 on the outer edge thereof, or distal from the fire pit 100, is a vent panel 204. The vent panel 204 may be vertical. The vent panel 204 may define a plurality of openings 206 that admit ventilation air. The arrangement of the descending vent panel 204 and/or the downward sloping surround 202 allow for ventilation or intake air to the outer wall 104 of the firepit 100 even when the fire pit 100 is installed in a non-ventilated structure and/or the walls of the structure are thick (e.g., so long as the structure walls to not directly contact the outer wall 104 of the firepit 100).

The number of openings 206 may vary. In some embodiments, the openings 206 are present on half or more of the circumference of the vent panel. In various embodiments, the openings 206 may be oblong, circular, square, rectangular, or have other shapes. Additionally, not all openings 206 are necessarily identically shaped. Ventilation may also be provided on the surround 202.

As illustrated, the masonry installation 220 comprises a cylindrical wall 224 with a circular open top 226 surrounded by a circular top or ledge 228. The ventilation insert ring 200 may rest on or be affixed to the ledge 228 and interpose the fire pit 100 and the masonry wall 224. When installed, the fire pit 100 may be spaced apart from the wall 224 sufficiently that air can flow into the fire pit wall 104 by entering the vent openings 206 and travelling downward into the opening 226 of the masonry installation 220.

The masonry installation 220 is intended to be exemplary and serves as a stand, or support structure. Any structure capable of supporting the fire pit's 100 size and weight could be utilized along with the fire pit ventilation ring insert 200 or others according to the present disclosure. Such installation structure could comprise brick, concrete, treated wood, wrought iron, or other materials. Whether the installation structure provides ventilation, is air permeable, or sealed, the fire pit ventilation insert ring 200 ensures that adequate combustion air flow is provided to the fire pit 100 under most or all conditions to allow the fire pit 100 to function as intended with combustion air entering through the walls rather than primarily through the top, which can lead to excessive smoking and other issues.

Figure 4:
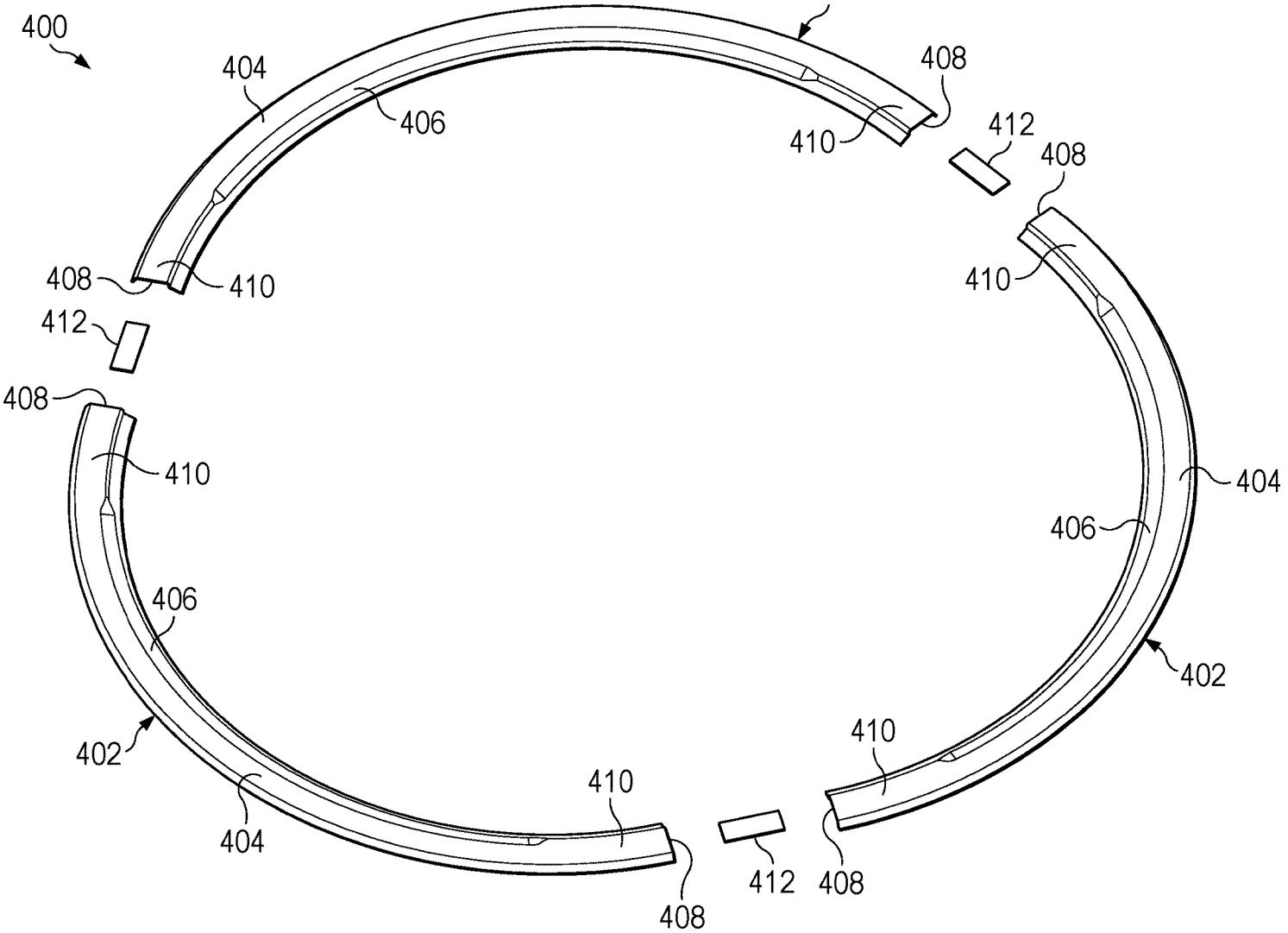
FIG. 4 is an exploded view of another fire pit ventilation insert ring according to aspects of the present disclosure.

Referring now to FIG. 4, an exploded view of another fire pit ventilation insert ring 400 according to aspects of the present disclosure is shown. The fire pit ventilation insert ring 400 is shown installed for use in FIG. 5. In the embodiment shown, the ventilation insert ring 400 comprises a plurality of segments 402 that may be generally in the form or an arc of a circle of the completed ventilation insert ring 400. As illustrated, three equally sized segments 402 are provided. One of skill in the art will appreciate that this number may vary and that all segment need not necessarily be of the same size or arc length. However, use of three segments 402 of equal length provides for convenient assembly and installation as well as reducing packaging size for shipment and the like.

Each segment 402 comprises a panel 404 with a rebated or recessed portion 406. The rebated portion 406 is spaced apart from the top cover 110 of the fire pit 100 when the insert ring 400 is installed. On opposite ends 408 of the panel 404 are support ledges 410 that receive the rim 112 of the firepit 100 when installed. Thus, the firepit 100 is supported but the rebated portions 406 are spaced apart from the firepit 100, the top cover 100, and the rim 112 to define ventilation openings 502.

Figure 5:
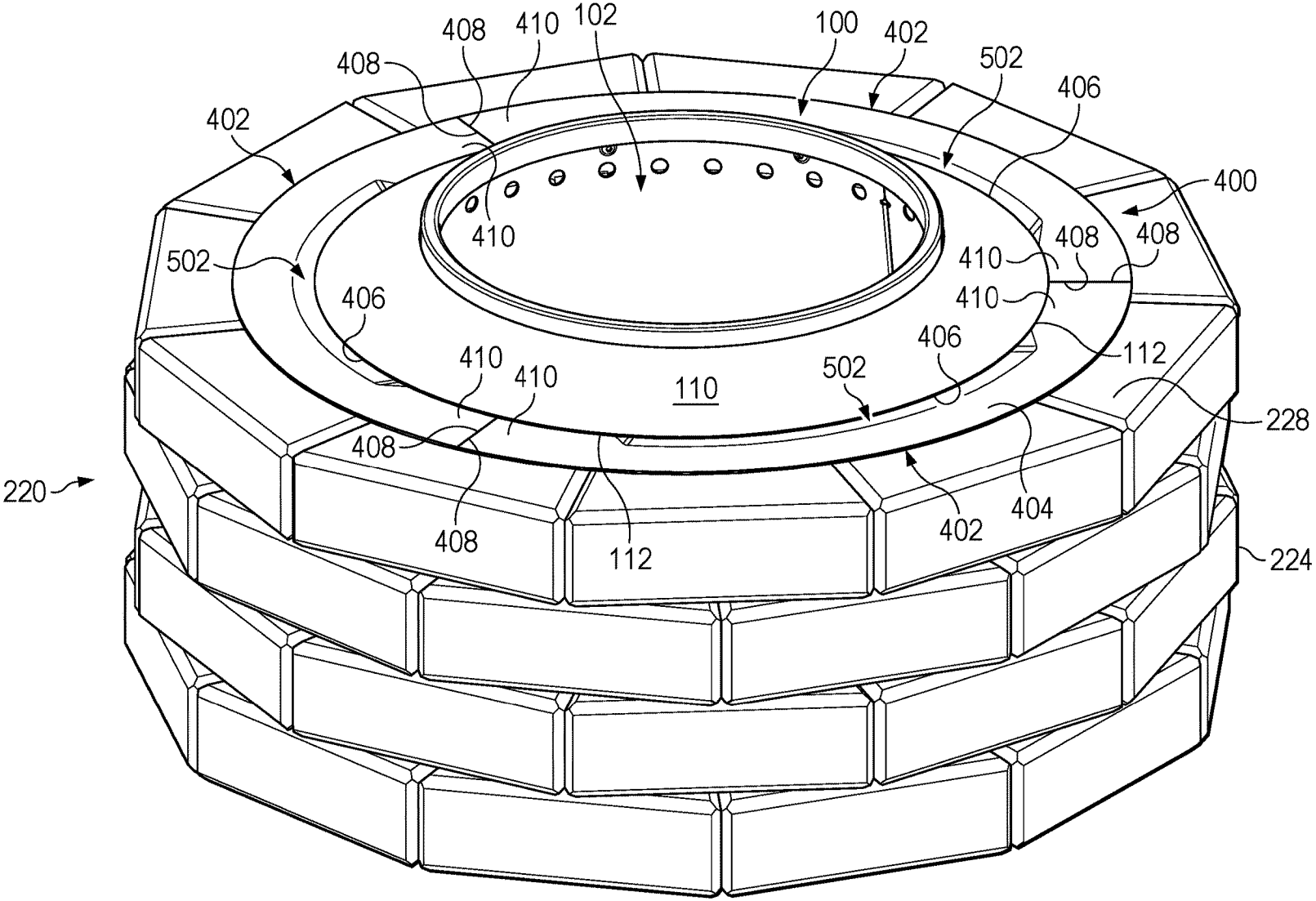
FIG. 5 is a perspective view of a masonry installation of a fire pit utilizing the fire pit ventilation ring of FIG. 4.

As there are three segments 402, a mechanism may be provided for joining the segments together to complete the insert ring 400. As shown, the opposed ends 408 are configured to receive connectors 412 where one segment 402 joins to the other. The ends 408 may be folded similar to a rail joiner such that the connector 412 is retained by each end 408 in a friction fit. The connector 412 may comprise planar piece of material allowing the ends 408 to join together in a flush manner as shown in FIG. 5. In other embodiments, the segments 408 may be permanently affixed together by, for example, being welded to the connectors 412. When assembled, or if constructed from a single circular segment, the insert ring 400 may be considered as a single panel defining a plurality of inwardly projecting support ledges 410 and defining a plurality of rebated portions 406.

As can be seen in FIG. 5, the panels 404 may be slightly sloped and may match any slope of the top cover 110. Thus, when the fire pit 100 is installed using the insert ring 400 the appearance is of a continuous shield or cover surrounding the combustion chamber 102. The operation of the insert ring 400 with respect to an operational fire pit 100 in an installation 220 is similar to the insert ring 100 described above, but for the location of the ventilation openings 502 and the more flush mounted appearance. It will also be appreciated that the rebated portions 406 and/or any outward down slope or angle of the panels 404 provide for intake air or ventilation to reach the outer wall 104 of the fire pit 100 even if the installation 220 or support structure is non-ventilated (e.g., so long as there remains space between the outer wall 104 of the fire pit 100 and the installation wall 224).

It is to be understood that the terms "including", "comprising", "consisting" and grammatical variants thereof do not preclude the addition of one or more components, features, steps, or integers or groups thereof and that the terms are to be construed as specifying components, features, steps or integers.

If the specification or claims refer to "an additional" element, that does not preclude there being more than one of the additional element.

It is to be understood that where the claims or specification refer to "a" or "an" element, such reference is not be construed that there is only one of that element.

It is to be understood that where the specification states that a component, feature, structure, or characteristic "may", "might", "can" or "could" be included, that particular component, feature, structure, or characteristic is not required to be included.

Where applicable, although state diagrams, flow diagrams or both may be used to describe embodiments, the invention is not limited to those diagrams or to the corresponding descriptions. For example, flow need not move through each illustrated box or state, or in exactly the same order as illustrated and described.

Methods of the present invention may be implemented by performing or completing manually, automatically, or a combination thereof, selected steps or tasks.

The term "method" may refer to manners, means, techniques and procedures for accomplishing a given task including, but not limited to, those manners, means, techniques and procedures either known to, or readily developed from known manners, means, techniques and procedures by practitioners of the art to which the invention belongs.

The term "at least" followed by a number is used herein to denote the start of a range beginning with that number (which may be a ranger having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%.

When, in this document, a range is given as "(a first number) to (a second number)" or "(a first number)-(a second number)", this means a range whose lower limit is the first number and whose upper limit is the second number. For example, 25 to 100 should be interpreted to mean a range whose lower limit is 25 and whose upper limit is 100. Additionally, it should be noted that where a range is given, every possible subrange or interval within that range is also specifically intended unless the context indicates to the contrary. For example, if the specification indicates a range of 25 to 100 such range is also intended to include subranges such as 26-100, 27-100, etc., 25-99, 25-98, etc., as well as any other possible combination of lower and upper values within the stated range, e.g., 33-47, 60-97, 41-45, 28-96, etc. Note that integer range values have been used in this paragraph for purposes of illustration only and decimal and fractional values (e.g., 46.7-91.3) should also be understood to be intended as possible subrange endpoints unless specifically excluded.

It should be noted that where reference is made herein to a method comprising two or more defined steps, the defined steps can be carried out in any order or simultaneously (except where context excludes that possibility), and the method can also include one or more other steps which are carried out before any of the defined steps, between two of the defined steps, or after all of the defined steps (except where context excludes that possibility).

Further, it should be noted that terms of approximation (e.g., "about", "substantially", "approximately", etc.) are to be interpreted according to their ordinary and customary meanings as used in the associated art unless indicated otherwise herein. Absent a specific definition within this disclosure, and absent ordinary and customary usage in the associated art, such terms should be interpreted to be plus or minus 10% of the base value.

Thus, the present invention is well adapted to carry out the objects and attain the ends and advantages mentioned above as well as those inherent therein. While the inventive device has been described and illustrated herein by reference to certain preferred embodiments in relation to the drawings attached thereto, various changes and further modifications, apart from those shown or suggested herein, may be made therein by those of ordinary skill in the art, without departing from the spirit of the inventive concept the scope of which is to be determined by the following claims.

What is claimed is:

1. A fire pit insert ring for use with a fire pit installation comprising:

a surround defining an opening sized to accept a fire pit; and a vent panel attached to the surround and defining a plurality of vent openings;

wherein the vent panel provide airflow into the installation and to an outer wall of the firepit;

wherein the opening defined by the surround is sized to pass at least a portion of the outer wall of the firepit therethrough and to suspend the firepit in the installation by a rim of an upper cover of the fire pit;

wherein the vent panel descends below the surround;

wherein a circumference of the vent panel is sized to rest on an upper ledge of the installation and provides air flow below the surround and inward toward the outer wall of the firepit;

wherein the surround slopes downwardly away from the upper cover of the fire pit; and wherein the vent panel slopes downwardly from the surround at an angle exceeding a downward sloping angle of the surround.

2. The fire pit insert ring of claim 1, wherein the downward sloping angle of the surround is approximately equal to a downward sloping angle of the upper cover of the fire pit.

3. A fire pit insert ring for use with a fire pit installation comprising:

a surround having a panel spanning a distance between a firepit and an upper ledge of the installation suspending the fire pit insert ring partially inside the installation;

wherein the surround defines an opening;

wherein the panel has at least one support ledge in contact with the fire pit and at least one rebated portion spaced apart from the firepit such that air flow is provided between the rebated portion and the firepit allowing air flow into the installation;

wherein the opening defined by the surround is sized to pass at least a portion of the outer wall of the firepit therethrough and to suspend the firepit in the installation by a rim of an upper cover of the fire pit;

wherein the vent panel descends below the surround;

wherein a circumference of the vent panel is sized to rest on an upper ledge of the installation and provides air flow below the surround and inward toward the outer wall of the firepit;

wherein the surround slopes downwardly away from the upper cover of the fire pit; and wherein the vent panel slopes downwardly from the surround at an angle exceeding a downward sloping angle of the surround.

4. The fire pit insert ring of claim 3, wherein the panel is divided into segments, each segment having a support ledge on both opposite ends thereof and a rebated portion on a medial portion thereof.

5. The fire pit insert ring of claim 4, wherein the segments join together to define a circular opening accepting the fire pit.

6. The fire pit insert ring of claim 5, wherein the support ledges of each segment face inwardly and support the fire pit in a suspended fashion via a rim on an upper cover of the fire pit.

7. The fire pit insert ring of claim 5, wherein the panels have a downward slope away from the fire pit that approximately equates to a downward slope of the upper cover of the fire pit.

8. A fire pit installation comprising: a support structure having a support wall defining an opening on a top thereof and an upper ledge surrounding the opening; a fire pit having: an outer wall with an air intake defined therein; an inner wall defining a combustion chamber; and an upper cover spanning between the outer wall and the inner wall, the upper cover providing a rim protruding outwardly from the outer wall; and an insert ring that suspends the fire pit by the rim at least partially within the opening of the support structure, the insert ring providing ventilation into the support structure to the outer wall of the fire pit; and a vent panel attached to the surround and defining a plurality of vent openings;

wherein the insert ring has a surround defining an opening receiving the fire pit and a vent panel descending from the surround to contact the upper ledge of the support structure;

wherein the opening defined by the surround is sized to pass at least a portion of the outer wall of the firepit therethrough and to suspend the firepit in the installation by a rim of the upper cover of the fire pit;

wherein the vent panel descends below the surround;

wherein a circumference of the vent panel is sized to rest on an upper ledge of the installation and provides air flow below the surround and inward toward the outer wall of the firepit;

wherein the surround slopes downwardly away from the upper cover of the fire pit; and wherein the vent panel slopes downwardly from the surround at an angle exceeding a downward sloping angle of the surround.

9. The fire pit installation of claim 8, wherein the surround defines a circular opening.

10. The fire pit installation of claim 8, wherein the vent panel descends approximately vertically from the surround.

11. The fire pit installation of claim 10, wherein the surround slopes outwardly down from the fire pit.

12. The fire pit installation of claim 8, wherein the insert ring defines a circular opening and provides a plurality of inwardly projecting support ledges that engage the rim of the fire pit.

13. The fire pit installation of claim 12, wherein the insert ring defines a plurality of rebated portions spaced apart from the fire pit providing the ventilation into the support structure.

14. The fire pit installation of claim 13, wherein the insert ring is divided into a plurality of separable segments each having at least one of the plurality of support ledges and at least one of the plurality of rebated portions.

* * * * *